US005786737A

United States Patent [19]

Goto

[11] Patent Number: 5,786,737

[45] Date of Patent: Jul. 28, 1998

[54] IMPEDANCE MATCHING CIRCUIT AND THIN FILM MEASURING PROBER

[75] Inventor: Seiki Goto, Tokyo, Japan

[73] Assignee: Mitsubishi Denki Kabushiki Kaisha, Tokyo, Japan

[21] Appl. No.: 797,515

[22] Filed: Feb. 6, 1997

[30] Foreign Application Priority Data

Aug. 9, 1996 [JP] Japan ..... 8-211560

[51] Int. Cl.[6] ..... H01P 5/00

[52] U.S. Cl. ..... 333/33; 330/51; 330/286

[58] Field of Search ..... 333/32, 33, 35; 330/51, 286

[56] References Cited

U.S. PATENT DOCUMENTS

| | | | |
|---|---|---|---|
| 4,929,855 | 5/1990 | Ezzeddine | 333/104 X |
| 5,159,297 | 10/1992 | Tateno | 333/104 |
| 5,202,649 | 4/1993 | Kashiwa | 333/33 |
| 5,343,172 | 8/1994 | Utsu et al. | 333/32 |

FOREIGN PATENT DOCUMENTS 3195108 8/1991 Japan .

7235802 9/1995 Japan .

*Primary Examiner*—Paul Gensler

*Attorney, Agent, or Firm*—Leydig, Voit & Mayer, Ltd.

[57] ABSTRACT

An impedance matching circuit disposed on one of input and output sides of an element to be evaluated matches I/O impedances of the element. The impedance matching circuit includes a matching substrate having a surface, a main line on the surface, passive circuits having stubs and FETs alternatingly connected in series and electrically connected to the main line to change impedance of the main line, and a plurality of switching FETs connected in series between the main line and the respective passive circuits switched on and off in accordance with characteristics of the element. The impedances of the matching substrate can be changed as required by electrically connecting the passive circuit to the main line by switching of the FETs. Even when a considerable change occurs in the I/O impedances of the element due to fabrication variations and in large signal (non-linear) operation of a power FET, I/O impedances of an evaluating object can be matched easily and promptly by appropriate switching of the FETs.

11 Claims, 8 Drawing Sheets

IMPEDANCE MATCHING CIRCUIT AND THIN FILM MEASURING PROBER

FIELD OF THE INVENTION

The present invention relates to an impedance matching circuit and a thin film measuring prober and, more particularly, to an impedance matching circuit and a thin film measuring prober for evaluating a semiconductor device used in a frequency band of several hundred MHz or more, which circuit and prober are designed to improve matching operation of a matching circuit.

BACKGROUND OF THE INVENTION

Matching circuits which are employed for high-power operation of transistors such as a field effect transistor (hereinafter referred to as FET) and a heterojunction bipolar transistor (hereinafter referred to as HBT), are realized, for example, on a single substrate together with a transistor as in an MMIC and on a dielectric MIC substrate. In either case, however, it is required to modify the impedance matching circuits when input/output impedances (hereinafter referred to as I/O impedances) of an element as an object to be evaluated are varied due to changes of the fabrication process and variation in the structural parameters of the element.

In that case, it is necessary to reevaluate the element to obtain its design parameters in accordance with which the matching circuit is redesigned. This requires a great deal of labor and time. Particularly in the case of a high-power transistor, its gate width is increased and a resistance component connected to the transistor in parallel is increased, resulting in low I/O impedances. Therefore, the impedance matching should be made in the utmost vicinity of an element. In order to match the I/O impedances of a high-power transistor and the like, it is required to use a matching substrate 102 equipped with a strip line 100 of low impedance and a stub 101, as shown in FIG. 16(*a*).

A detailed description is given of a prior art matching circuit, referring to FIG. 16(*a*) and 16(*b*). In FIG. 16(*a*), reference numeral 103 designates a power FET, and its electrodes are connected to the strip line 100 by means of bonding wires 104. As shown in FIG. 16(*b*), the matching substrates 102 are placed at input and output sides of the FET 103, connected to input and output matching networks, respectively. The matching substrate 102 constituting the input matching network is provided with a plurality of land patterns 107 for impedance adjustment, connected to the strip line 105 by means of bonding wires 106.

As described above, the matching substrates 102 are generally designed depending on the characteristics of the transistor 103. In its impedance matching, a required number of the land patterns 107 for impedance adjustment are connected to the strip line 105 by the bonding wires 106.

Thus, in the prior art impedance matching circuit as described, it is necessary to change the impedances of the matching substrate for matching of transistors when variation is caused in I/O impedances of an element to be evaluated because of the problems in its fabrication processes or the like. As a result, the pattern modulation of the MIC substrate requires much time.

In evaluating an FET with the above matching circuit, large signal (non-linear) operation may occur in the transistor according to circumstances. In such cases, the impedance at which the maximum output of the transistor is achieved, varies with the levels of the input signals, and thus it is required to choose an impedance matching circuit which has an adjustable range in accordance with an FET as an object to be evaluated. As a result, the evaluation and the manipulation require much time.

Japanese Patent Unexamined Publication No. 3-195108 discloses conduction between stubs that is controlled by a transistor when adjusting impedances in the matching circuits. This, however, is a construction in which the adjustment of the circuit is limited to variations in impedance within a certain adjustable range. Therefore, this prior art structure is unsuitable for use for large signal operation in elements to be evaluated that have diverse impedance characteristics, and fails to solve the aforesaid problems.

SUMMARY OF THE PRESENT INVENTION

It is an object of the present invention to provide an impedance matching circuit that facilitates changing I/O impedances for large signal operation of an FET as an object to be evaluated, and for ready evaluation in a short period of time.

It is another object of the present invention to provide a thin film measuring prober that can measure, on a wafer, the impedance characteristics of an element that are similar to the impedance characteristics similar to those obtained when the element is mounted on a circuit.

Other objects and advantages of the invention will become apparent from the detailed description that follows. The detailed description and specific embodiments described are provided only for illustration since various additions and modifications within the scope of the invention will be apparent to those of skill in the art from the detailed description.

According to a first aspect of the present invention, an impedance matching circuit comprises a matching substrate having a surface; a main line disposed on the surface of the matching substrate; a plurality of passive circuits having a plurality of stubs and FETs alternatingly connected in series the passive circuits changing impedances of the main line by electrical connection to the main line; a plurality of switching FETs connected in series between the main line and the respective passive circuits, the switching FETs being on and off controlled in accordance with characteristics of an element to be evaluated.

In the impedance matching circuit, the impedances of the matching substrate are varied arbitrarily by controlling on-off operation of the field effect transistors to electrically connect the passive circuits to the main line. Therefore, when I/O impedances of the element to be evaluated varies considerably due to fabrication variations or the like, and when a large signal operation in a power FET, it is possible to match I/O impedances of the object to be evaluated easily and promptly by an appropriate on-off switching of the switching transistors. As a result, unlike the conventional case, it is not necessary to redesign the matching impedance circuit even when variation occurs in the impedances of the element to be evaluated, resulting in effective element evaluation.

According to a second aspect of the present invention, the impedance matching circuit of the first aspect, employs a switching FET which has a low loss in the on-state and exhibits characteristics similar to total reflection in the off-state. Thus, it is obtainable a configuration equivalent to that in which the passive circuit is physically connected or isolated from the main line.

According to a third aspect of the present invention, the impedance matching circuit of the first aspect, comprises a passive circuit that has plural stubs connected in series, and a field effect transistor for ground connection that is connected in series between a ground and an arbitrary junction point of the stubs connected in series. It is therefore possible to provide a short-circuited end at any position of the stubs which constitute the passive circuit, thereby extending the function of the matching circuit.

According to a fourth aspect of the present invention, in the impedance matching circuit of the first aspect, the passive circuit is composed of various circuit components such as an inductor, a resistor, and a capacitor. Therefore, it is possible to simulate a matching circuit where the components other than a stub are connected to the main line. As a result, the adjustable range of impedance is expanded, and a state of matching between the circuit and the element to be evaluated can be changed as demanded, thereby extending the function of the matching circuit.

According to a fifth aspect of the present invention, in the impedance matching circuit of the fourth aspect, a FET for ground connection is connected in series between the ground and the passive circuit. Therefore, the state of the passive circuit can be switched between the short-circuited state and the opened state, thereby extending the function of the matching circuit.

According to a sixth aspect of the present invention, the impedance matching circuit of the first aspect, includes an RF probe pad for on-wafer measurement that is provided at the input and output ends of the matching substrate. Therefore, an S (scattering) parameter of the matching substrate can be easily taken and, when adjusting the matching circuit to an element as an object to be measured, the setting of the impedance can be carried out on a wafer. This reduces the time required for the adjustment of the matching circuit, resulting in improved operation efficiency.

According to a seventh aspect of the present invention, in a thin film measuring prober, the impedance matching circuit of the first aspect is connected to a measuring electrode which is applied to an element to be evaluated, and the impedance matching circuit and the measuring electrode are mounted on a supporting body comprised of a thin film insulator. Therefore, it is possible to measure electrical characteristics of an element to be evaluated in a state similar to that in which the element is mounted on a circuit, resulting in more precise circuit simulation.

DETAILED DESCRIPTION OF THE PREFERRED EMBODIMENTS

Embodiment 1.

Figure 1:
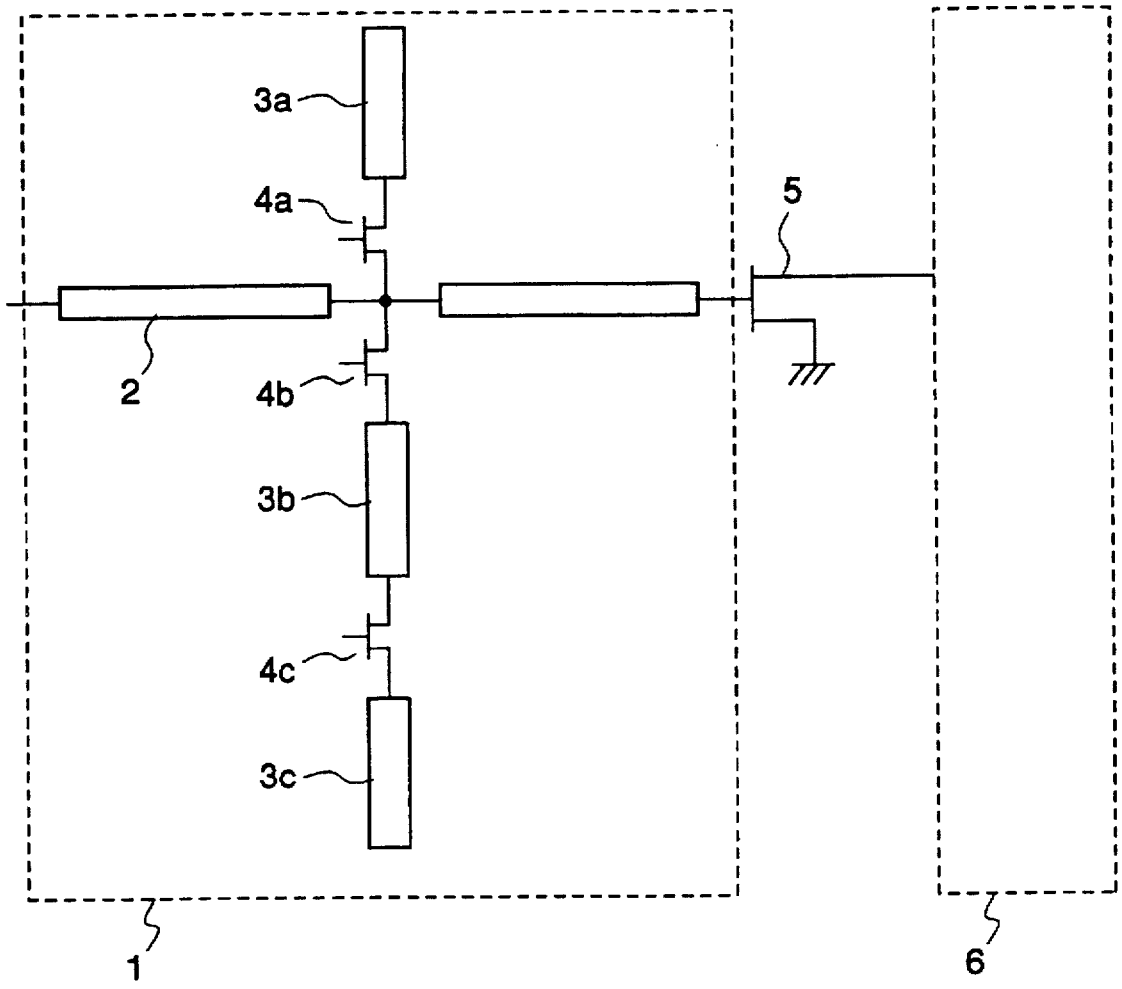
FIG. 1 is a circuit diagram of an impedance matching circuit in accordance with a first embodiment of the present invention.

FIG. 1 shows a schematic diagram of an impedance matching circuit in accordance with a first embodiment of the present invention. In FIG. 1, reference numeral 1 designates an input matching circuit substrate made of a GaAs or the like and the substrate constitutes an input matching network. On the surface of the input matching circuit substrate 1, a main line 2 and a plurality of stubs 3*a* and 3*b* are disposed. Between the stubs, switching FETs 4*a*, 4*b*, 4*c* are disposed, and the length of the stubs connected to the main line 2 can be changed by on-off operation of the switching FETs 4*a*, 4*b*, and 4*c*. Numeral 5 designates a power FET as an element to be evaluated that is connected to the main line 2, numeral 6 designates an output matching circuit substrate that is disposed on an output side of the high power FET 5, and that constitutes an output matching network. The configuration of the output matching circuit substrate 6 is approximately the same as that of the input matching circuit substrate 1, and thus a detailed description of the structure is omitted.

The FET used as the switching FET should have a low loss in the on-state and its input/output ports should have characteristics similar to total reflection in the off-state. This FET can be realized by employing a FET whose gate width is relatively wide.

Figure 2:
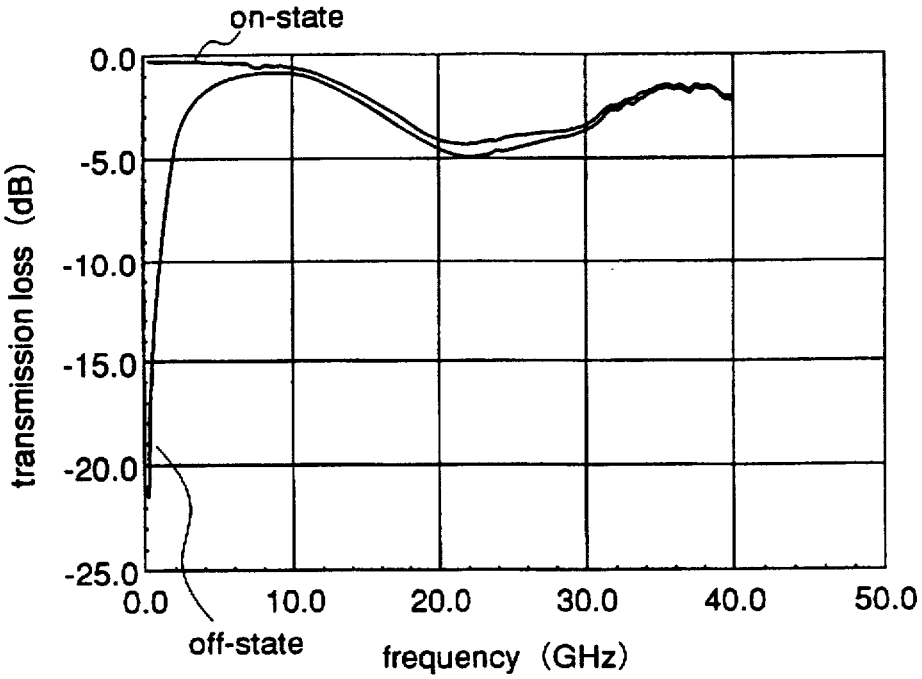
FIG. 2 is a diagram illustrating transmission loss of an FET which employs the impedance matching circuit when the FET is in the on-state.
Figure 3:
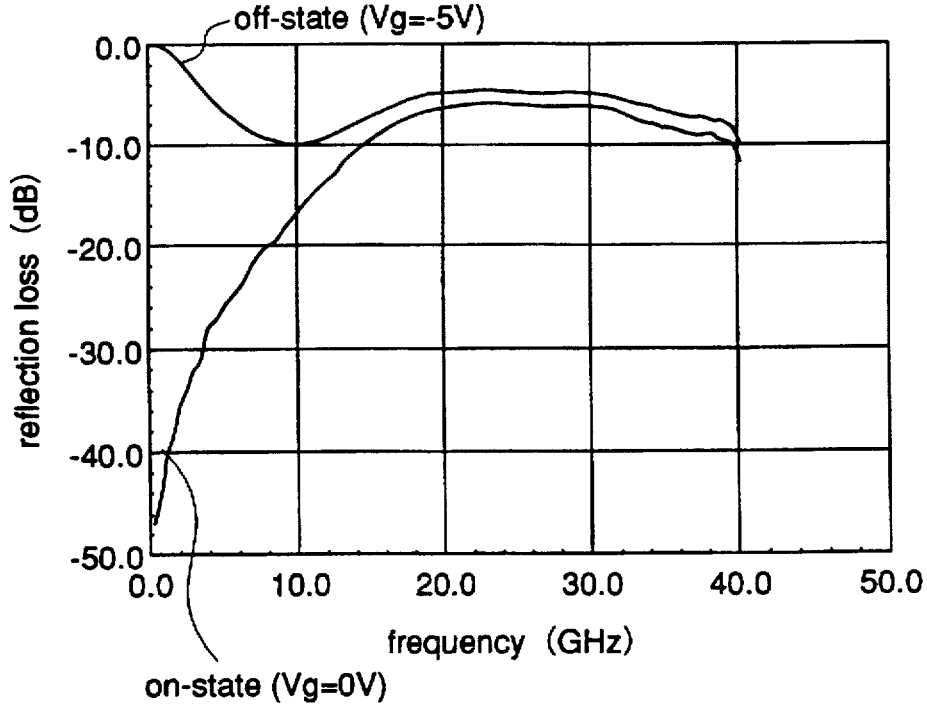
FIG. 3 is a diagram illustrating reflection loss of an FET which employs the impedance matching circuit when the FET is in the off-state.

FIG. 2 is a diagram showing a measured value of transmission loss of an FET in the on-state, which FET can be used as the aforesaid FETs 4*a*, 4*b*, and 4*c*. FIG. 3 is a diagram showing a measured value of reflection loss of an FET in the off-state. As shown in the figures, when the frequency is 1 GHz, the transmission loss of the FET in the on-state is −0.16 dB and the reflection loss of the FET in the off-state is −0.80 dB. This shows that the FET is applicable as a switching FET in a relatively low frequency range, such as L band.

Figure 4:
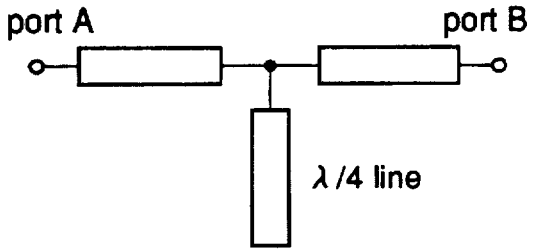
FIGS. 4(*a*) and 4(*b*) are model diagrams illustrating a circuit used in a simulation to exhibit characteristics of a switching FET of the impedance matching circuit in the off-state.
Figure 4:
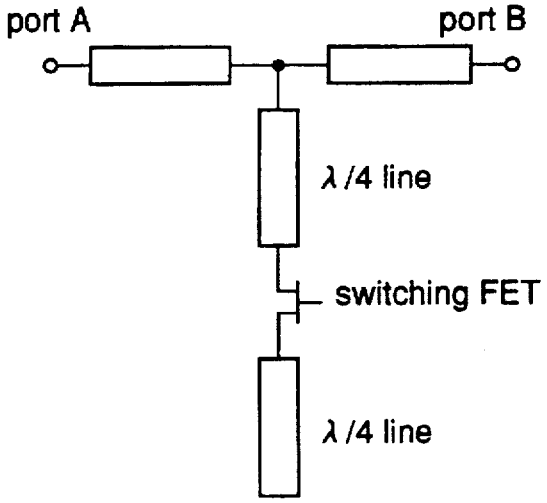

Next, a description is given of the operation of the matching circuit having the aforesaid configuration. FIG. 4(*a*) shows a main line and an λ/4 open stub disposed on a GaAs substrate. FIG. 4(*b*) shows a configuration allowing two λ/4 main lines to be connected through a switching FET.

Figure 5:
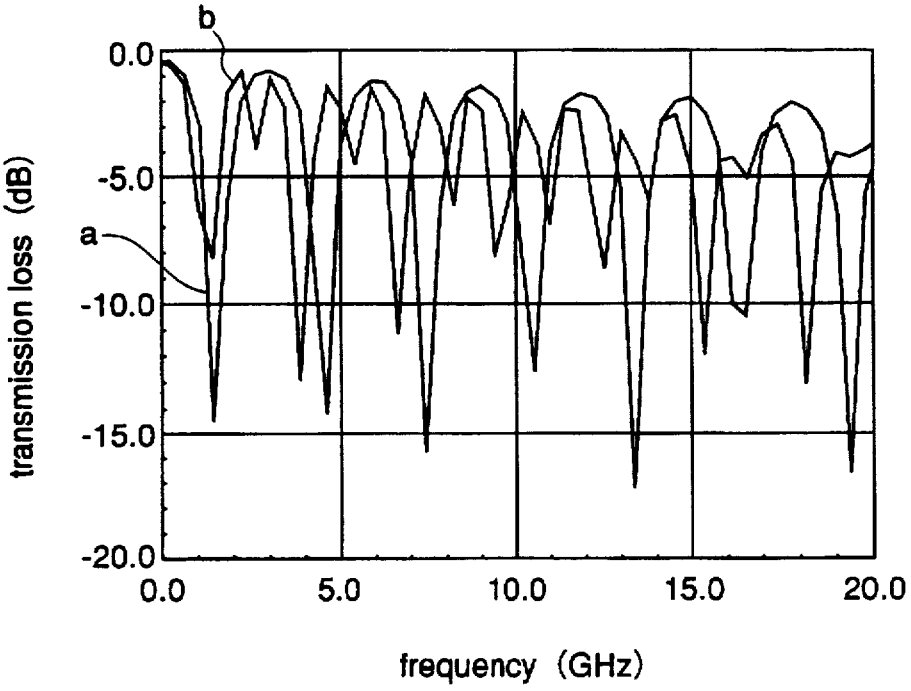
FIG. 5 is a diagram showing a result of transmission characteristic of a switching FET in the simulation.

FIG. 5 shows the result of a simulation in which transmission loss between ports A and B of the circuit shown in FIG. 4(*a*) is compared to the transmission loss between ports A and B of the circuit shown in FIG. 4(*b*) when the switching FET is in the off-state.

In a frequency band ranging up to 1 GHz, as shown in FIG. 5, the transmission loss of the circuit shown in FIG. 4(*a*) is approximately equal to that of the circuit shown in FIG. 4(*b*). This shows that an open stub can be realized when the switching FET is in the off-state.

Figure 6:
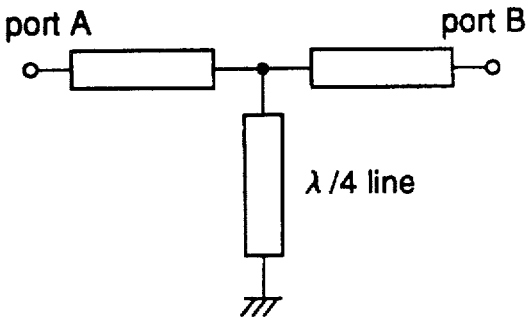
FIGS. 6(*a*) and 6(*b*) are model diagrams illustrating a circuit used in a simulation to exhibit characteristics of a switching FET of the impedance matching circuit in the on-state.
Figure 6:
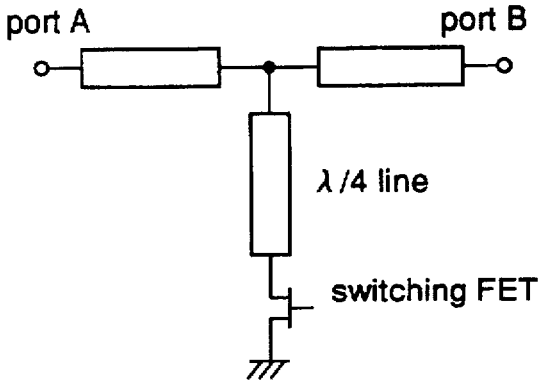
Figure 7:
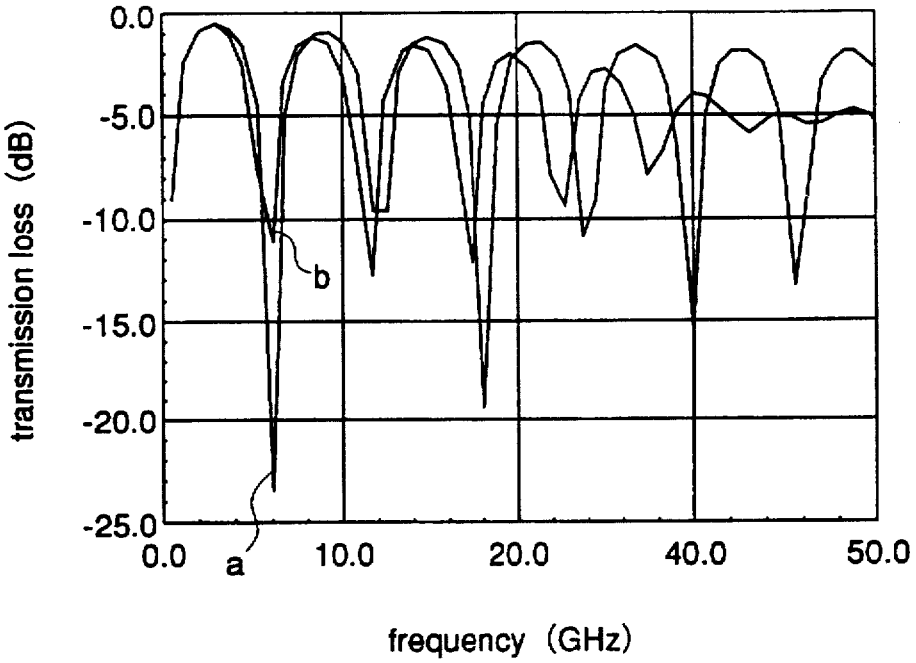
FIG. 7 is a diagram showing a result of transmission characteristics of a switching FET in the simulation.

FIG. 6(*a*) shows a circuit which has a short-circuited stub having a line length λ/4. FIG. 6(*b*) shows a circuit where a stub of line length λ/4 can be connected to a ground potential through a switching FET, and the FET is in the on-state in the figure. FIG. 7 shows the result of a comparison of transmission losses between ports A and B of these circuits, obtained through a simulation.

In a frequency band ranging up to 2 GHz, as shown in FIG. 7, the transmission loss of the circuit shown in FIG. 6(*a*) is in fair agreement with that of the circuit shown in FIG. 6(*b*). This shows that when a switching FET has a low loss, by setting the switching FET in the on-state, a property equal to that of a circuit where a short-circuited stub having a line length λ/4 is connected to a ground through a line is obtainable. Therefore, the length of the stub can be electrically changed. In the circuit of the configuration shown in FIG. 1, I/O impedances can be easily matched using an identical matching circuit, even in a large signal operation of a power FET 5 as an element to be evaluated, or when the power FET 5 has the fabrication variations.

Thus, in the first embodiment, a required stub line selected from the stub lines 3*a*, 3*b*, and 3*c* can be connected to the main line 2 by utilizing the switching FETs 4*a*, 4*b*, and 4*c* that have a low loss in the on-state and have characteristics similar to total reflection at their input/output ports in the off-state. Therefore, even when the I/O impedances of the power FET as an object to be evaluated are considerably changed due to fabrication variation or the like, or in large signal operation of the power FET, the I/O impedances of the matching circuits can be easily and promptly matched to those of the power FET 5 as an element to be evaluated, by appropriate on-off switching of the switching FETs 4*a*, 4*b*, and 4*c*. As a result, unlike the prior art circuits, it is not necessary to redesign the matching circuit, leading to effective evaluation of elements.

Embodiment 2.

Figure 8:
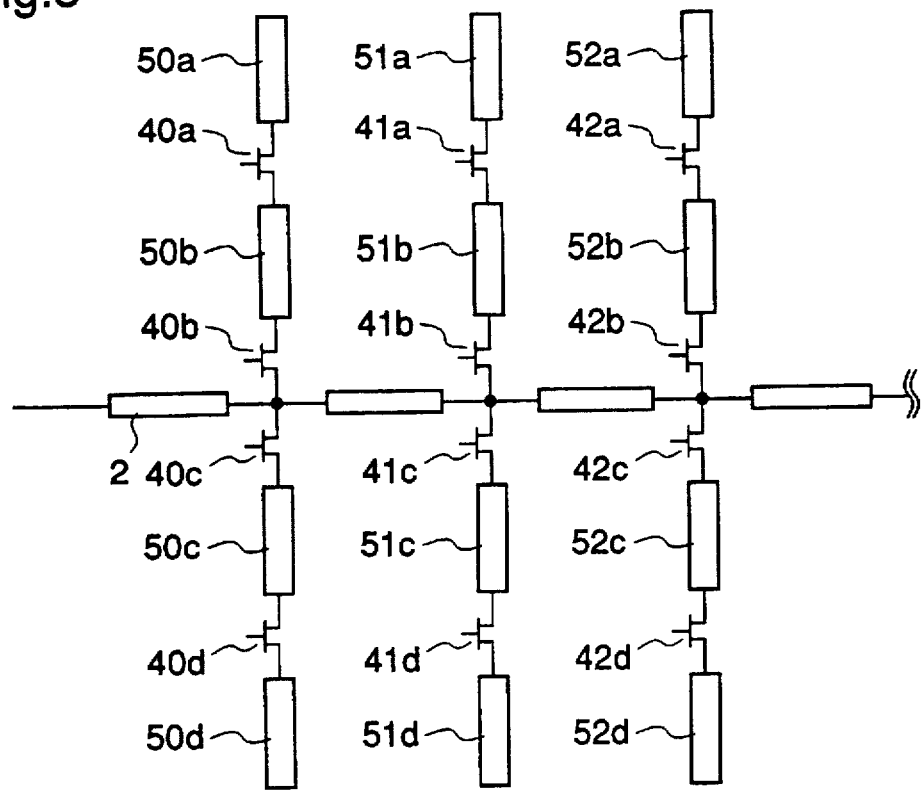
FIG. 8 is a circuit diagram of an impedance matching circuit in accordance with a second embodiment of the present invention, which circuit contains switching FETs and stubs connected in a matrix to expand its adjustable range of impedance.

FIG. 8 is a diagram illustrating a layout of stubs and switching FETs placed on a substrate of an impedance matching circuit of a second embodiment, and the stubs are connected to the main line 2 by means of the switching FETs. In this embodiment, the impedances of the matching substrate can be varied in a wide range by placing, on both sides of the main line 2, stubs 50*a* to 50*d*, 51*a* to 51*d*, 52*a* to 52*d*, switching FETs 40*a* to 40*d*, 41*a* to 41*d*, 42*a* to 42*d* in a matrix, and then changing the combination of switching FETS in the on-state.

Thus, in the second embodiment, the stubs 50*a* to 50*d*, 51*a* to 51*d*, 52*a* to 52*d*, and the switching FETs 40*a* to 40*d*, 41*a* to 41*d*, 42*a* to 42*d* are placed in a matrix, with the main line 2 in the center of the matrix. Therefore, the impedances of the matching substrate can be adjusted in a wider range, facilitating the evaluation.

Embodiment 3.

Figure 9:
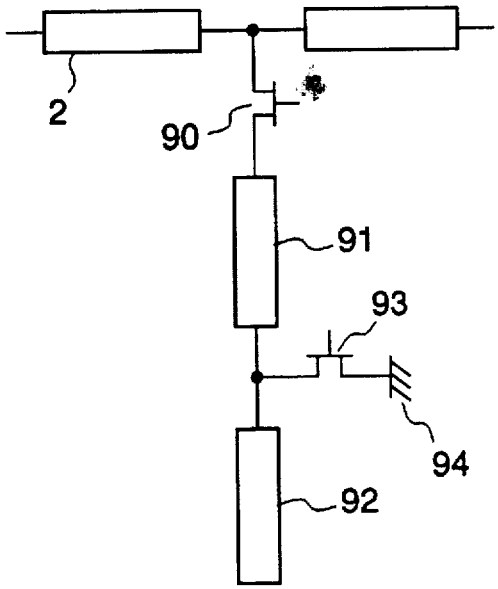
FIG. 9 is a circuit diagram of an impedance matching circuit in accordance with a third embodiment of the present invention, which circuit has a ground connected to a switching FET.

FIG. 9 shows a configuration realized on a substrate of an impedance matching circuit in accordance with a third embodiment of the present invention. As shown in FIG. 9, an end of a switching FET 93 is connected to a junction point between stubs 91 and 92 which are connected to the main line 2 via a switching FET 90, and the other end of the switching FET 93 is connected to a ground 94 which is connected to the substrate through a via hole or the like. In the configuration, when the switching FET 90 is in the on-state and the switching FET 93 is in the off-state, the stubs 91 and 92 constitute an open stub to be connected to the main line 2. When the switching FET 90 and the switching FET 93 are both in the on-state, the circuit is the same as one in which the stub 91, as the short-circuited stub, is connected to the main line 2.

Thus, in the third embodiment, the stubs 91 and 92 are connected to the main line 2 through the switching FET 90, and the switching FET 93 is placed at the junction point between the stubs 91 and 92, so that the junction point can be connected to the ground 94. Therefore, a short-circuited end can be provided with various positions of the stubs placed in a matrix on the substrate, thereby extending the function of the matching circuit.

Embodiment 4.

Figure 10:
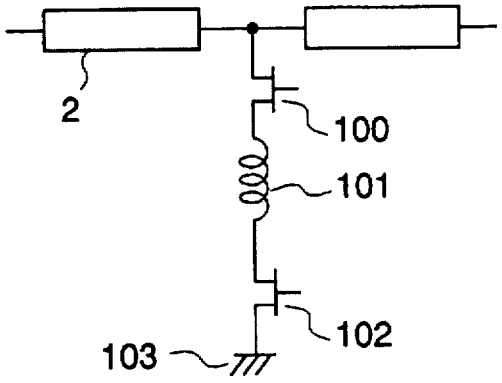
FIG. 10 is a circuit diagram of an impedance matching circuit in accordance with a fourth embodiment of the present invention, which circuit has an inductor is connected to a switching FET.

FIG. 10 shows a configuration realized on a substrate of an impedance matching circuit in accordance with a fourth embodiment of the present invention. As shown in FIG. 10, an end of a switching FET 100 is connected to the main line 2 and the other end of the FET 100 is connected to an inductor 101, and the other end of the inductor 101 is connected to a ground 103 through a switching FET 102. In this configuration, when the switching FET 100 and the switching FET 102 are both in the on-state, the inductor 101 having a short-circuited end is connected to the main line 2, and when the switching FET 100 is in the on-state and the switching FET 102 is in the off-state, the inductor 101 having an open end is connected to the main line 2.

Thus, in the fourth embodiment, the inductor 101 is connected to the main line 2 via the switching FET 100. Therefore, it is possible to simulate a matching circuit where the inductor is connected to the main line, extending the function of the matching circuit.

Embodiment 5.

Figure 11:
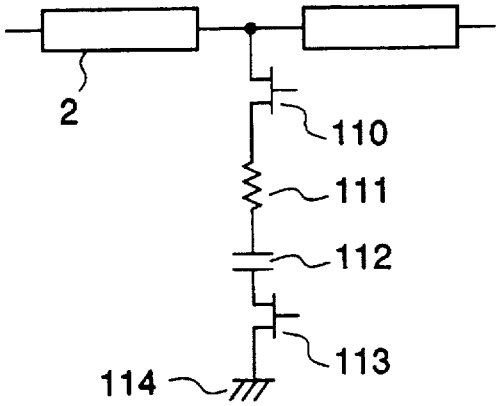
FIG. 11 is a circuit diagram of an impedance matching circuit in accordance with a fifth embodiment of the present invention, which circuit has a resistor connected to a switching FET.

FIG. 11 shows a configuration realized on a substrate of an impedance matching circuit in accordance with a fifth embodiment of the present invention. As shown in FIG. 11, an end of a switching FET 110 is connected to the main line 2 and the other end of the FET 110 is connected to a time constant circuit which has a resistor 111 and a capacitor 112 connected in series. In the figure, reference numeral 113 designates a switching FET placed between the capacitor 112 and a ground 114.

In this configuration, when the switching FET 110 and the switching FET 113 are both in the on-state, the resistor 111 having a short-circuited end is connected to the main line 2, and when the switching FET 110 is in the on-state and the switching FET 111 is in the off-state, the resistor 111 having an open end is connected to the main line 2.

As described above, in the fifth embodiment, the resistor 111 is connected to the main line 2 via the switching FET 110. Therefore, it is possible to simulate a matching circuit where the resistor is connected to the main line, thereby extending the function of the matching circuit.

Embodiment 6.

Figure 12:
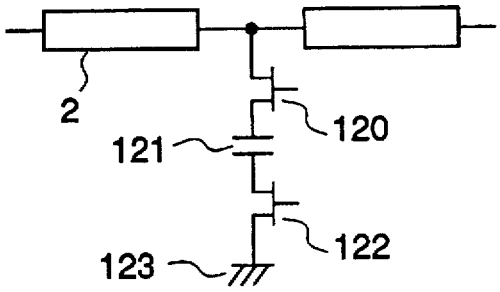
FIG. 12 circuit diagram of an impedance matching circuit in accordance with a sixth embodiment of the present invention, which circuit has a capacitor connected to a switching FET.

FIG. 12 shows a configuration realized on a substrate of an impedance matching circuit in accordance with a sixth embodiment of the present invention. As shown in FIG. 12, an end of a switching FET 120 is connected to the main line 2, and the other end of the FET 120 connected to an electrode of a capacitor 121. The other electrode of the capacitor 121 is connected to a ground 123 through a switching FET 122.

In this configuration, when the switching FET 120 and the switching FET 122 are both in the on-state, the capacitor 121 having a short-circuited end is connected to the main line 2, and when the switching FET 120 is in the on-state and the switching FET 122 is in the off-state, the capacitor 121 having an open end is connected to the main line 2.

Thus, in the sixth embodiment, the capacitor 121 is connected to the main line 2 through the switching FET 120. Therefore, it is possible to simulate a matching circuit where the capacitor is connected to the main line, thereby extending the function of the matching circuit.

Embodiment 7.

Figure 13:
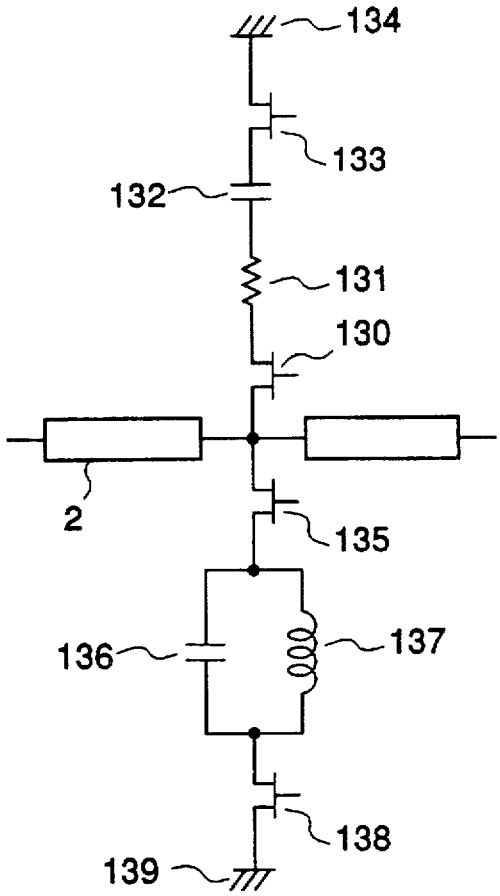
FIG. 13 is a circuit diagram of a lumped constant type impedance matching circuit in accordance with a seventh embodiment of the present invention, which circuit includes various combinations of LCR (inductor, capacitor, resistor).

FIG. 13 shows a configuration realized on a substrate of an impedance matching circuit in accordance with a seventh embodiment of the present invention. As shown in FIG. 13, an end of a series circuit comprising a resistor 131 and a capacitor 132 is connected to the main line 2 through a switching FET 130, and the other end of the series circuit is connected to a ground 134 through a switching FET 133, as shown in FIG. 11. In addition, an end of a circuit in which a capacitor 136 and an inductor 137 are connected in parallel is connected to the main line 2 through a switching FET 135, and the other end of the circuit is connected to a ground 139 through a switching FET 138.

In the above circuit, when the switching FET 130 and the switching FET 133 are both in the on-state, the resistor 131 having a short-circuited end is connected to the main line 2, as in the circuit shown in FIG. 11, and when the switching FET 130 is in the on-state and the switching FET 133 is in the off-state, the resistor 131 having an open end is connected to the main line 2.

Furthermore, when the switching FET 135 and the switching FET 138 are in the on-state, the circuit in which the capacitor 136 and the inductor 137 are connected in parallel is connected to the main line 2 as a short-circuit. When the switching FET 135 is in the on-state and the switching FET 138 is in the off-state, a circuit in which the capacitor 136 and the inductor 137 are connected in parallel is connected to the main line 2 with an open end.

Thus, in the seventh embodiment, it is possible to simulate the matching circuit where the lumped constant circuit comprising the capacitor 136 and the inductor 137 is connected to the main line 2 through the switching FET 135. Therefore, the impedance adjustment range is expanded, and the matching state between the circuit and an element to be evaluated can be changed as needed, thereby further extending the function of the matching circuit.

Although the seventh embodiment refers to a circuit in which a capacitor and an inductor are connected in parallel, a lumped constant circuit in which other elements are connected in parallel may be used, and two or more elements may be connected in the circuit.

Embodiment 8.

Figure 14:
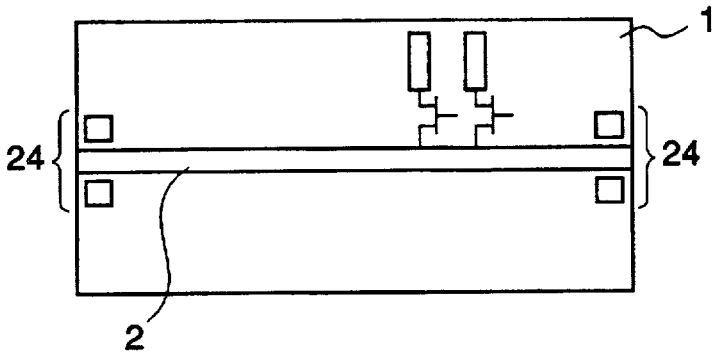
FIG. 14 is a schematic diagram illustrating an impedance matching circuit which contains an RF probe pad in accordance with an eighth embodiment of the present invention.

FIG. 14 is a diagram illustrating a structures of a substrate of the impedance matching circuit in accordance with an eighth embodiment of the present invention. In FIG. 14, reference numeral 24 designates an RF probe pad that is disposed at the input and output sides of the main line 2 on the input matching circuit substrate 1.

The RF probe pad 24 allows probes to come into contact with the input matching circuit substrate 1 on which a plurality of matching circuits having various configurations as described in the first to seventh embodiments are realized. Therefore, S (scattering) parameters of the matching circuit substrate 1 alone can be obtained by the on-off switching of the respective switching FETs, which connect the elements that constitute the individual passive circuits on the input matching circuit substrate 1. Consequently, when adjusting the matching circuit to an element as an object to be measured, the setting of impedance can be carried out on a wafer. This reduces the time needed in setting the impedance of the matching circuit, increasing operational efficiency.

Although the eighth embodiment refers to a case in which the RF probe pads are disposed on the input matching circuit substrate 1, the pads may be disposed on the output matching circuit substrate.

Embodiment 9.

Figure 15:
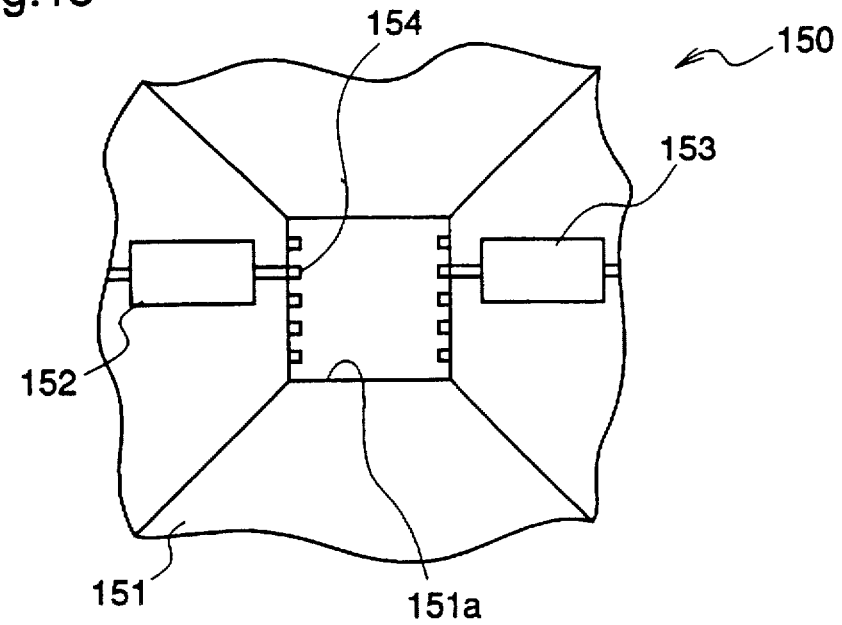
FIG. 15 is a schematic diagram of an impedance matching circuit which is incorporated in a thin film prober in accordance with a ninth embodiment of the present invention.
Figure 16:
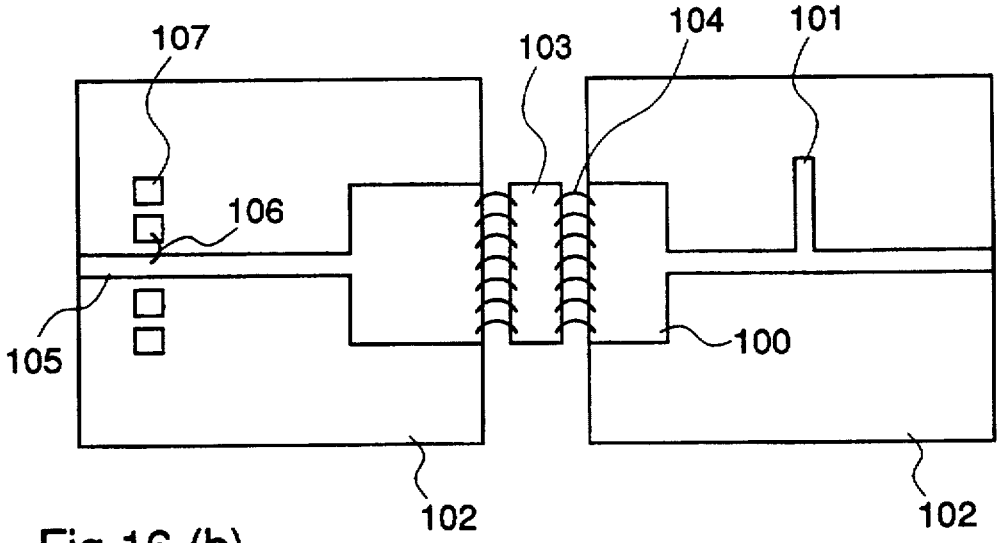
Prior Art Fig.16 (a)
FIG. 16 is a schematic diagram illustrating impedance matching circuit substrates used for a conventional MIC.
Figure 16:
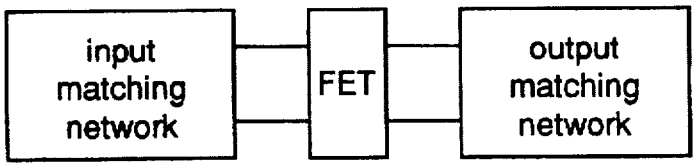

FIG. 15 is a diagram illustrating a structure of a thin film prober having an impedance matching circuit in accordance with a ninth embodiment of the present invention. A thin film probe card 150 has a structure where an input matching circuit substrate 152 and an output matching circuit substrate 153 each having any of the configurations described as the first to seventh embodiments are incorporated into a supporting body 151 made of an insulating material such as polyimide or the like. In the input matching circuit substrate 152 and the output matching circuit substrate 153, each main line is electrically connected to a probe 154 which is disposed at an opening 151*a* of the supporting body 151.

In the ninth embodiment, the measurement of the electrical characteristics of an element to be evaluated by previously adjusting the impedances of the input matching circuit substrate 152 and the output matching circuit substrate 153 on the thin film probe card 150 to the same values as an impedance of a substrate when an element as a measuring object is actually incorporated into the circuit to be used, and by bringing the probe 154 into contact with the input and output of the element to be evaluated, makes it possible to measure the electrical characteristics of the element to be evaluated in a wafer in a state with results similar to those when the element is mounted on a circuit, resulting in more precise circuit simulation.

What is claimed is:

1. An impedance matching circuit for matching input and output impedances of an element to be evaluated comprising:

a matching substrate having a surface;

a main transmission line disposed on the surface of the matching substrate and having an input terminal, an output terminal, and an impedance between the input and output terminals; and a circuit comprising stubs and field effect transistors alternatingly connected in series, the circuit being electrically connected through one of the field effect transistors to the main transmission line at a point spaced from the input terminal and the output terminal, for changing the impedance of the main transmission line, the field effect transistors being independently switchable on and off in accordance with characteristics of the element whereby the impedance of the main transmission line between the input terminal and the output terminal is changed.

2. The impedance matching circuit as defined in claim 1 wherein one of the stubs has an inductive electrical characteristic.

3. The impedance matching circuit as defined in claim 1 wherein one of the stubs has an resistive electrical characteristic.

4. The impedance matching circuit as defined in claim 1 wherein one of the stubs has an capacitive electrical characteristic.

5. The impedance matching circuit as defined in claim 2 including a field effect transistor connected in series between the stub having an inductive electrical characteristic and ground.

6. The impedance matching circuit as defined in claim 3 including a field effect transistor connected in series between the stub having a resistive electrical characteristic and ground.

7. The impedance matching circuit as defined in claim 4 including a field effect transistor connected in series between the stub having a capacitive electrical characteristic and ground.

8. The impedance matching circuit as defined in claim 1 including RF probe pads for on-wafer RF measurement disposed at the input and output terminals of the main transmission line on the matching circuit substrate.

9. The impedance matching circuit as defined in claim 1 including a plurality of circuits including stubs and field effect transistors alternatingly connected in series, the circuits being connected through respective ones of the field effect transistors to the main transmission line at corresponding, different points spaced from the input terminal and the output terminal.

10. A thin film measuring prober comprising:

a measuring electrode connected to an impedance matching circuit and contacting an electrode of the element to be evaluated, the matching circuit including:

a matching substrate having a surface;

a main transmission line disposed on the surface of the matching substrate and having an input terminal, an output terminal, and an impedance between the input and output terminals; and a circuit including stubs and field effect transistors alternatingly connected in series, the circuit being electrically connected through one of the field effect transistors to the main transmission line at a point spaced from the input terminal and the output terminal, for changing the impedance of the main transmission line, the field effect transistors being independently switchable on and off in accordance with characteristics of the element whereby the impedance of the main transmission line between the input terminal and the output terminal is changed; and a supporting body comprising a thin film insulator supporting the impedance matching circuit and the measuring electrode.

11. An impedance matching circuit for matching input and output impedances of an element to be evaluated comprising:

a matching substrate having a surface;

a main transmission line disposed on the surface of the matching substrate and having an input terminal, an output terminal, and an impedance between the input and output terminals; and a first circuit including a first stub and a first field effect transistor connected in series, the first field effect transistor connecting the first stub to the main transmission line at a point spaced from the input terminal and the output terminal, and a second circuit including a second stub and a second field effect transistor, the second stub and the second field effect transistor each being connected together and to the first stub at a common junction, the second field effect transistor being connected in series between the common junction and ground, the first and second field effect transistors being independently switchable on and off whereby the impedance of the main transmission line between the input terminal and the output terminal is changed.

* * * * *